US007820260B2

(12) United States Patent
Maggioni

(10) Patent No.: US 7,820,260 B2
(45) Date of Patent: Oct. 26, 2010

(54) PACKAGE, PARTICULARLY FOR HORTICULTURAL PRODUCTS AND FOOD PRODUCTS IN GENERAL, MANUFACTURABLE WITH AUTOMATIC PACKAGING MACHINES

(75) Inventor: Pierluigi Maggioni, Barzano' (IT)

(73) Assignee: Tenax S.p.A., Vigano' (IT)

( * ) Notice: Subject to any disclaimer, the term of this patent is extended or adjusted under 35 U.S.C. 154(b) by 202 days.

(21) Appl. No.: 11/920,552

(22) PCT Filed: May 16, 2006

(86) PCT No.: PCT/EP2006/004619

§ 371 (c)(1),
(2), (4) Date: Nov. 16, 2007

(87) PCT Pub. No.: WO2006/125552

PCT Pub. Date: Nov. 30, 2006

(65) Prior Publication Data

US 2009/0104391 A1 Apr. 23, 2009

(30) Foreign Application Priority Data

May 25, 2005 (IT) ..... MI2005A0964

(51) Int. Cl.
*B56D 30/06* (2006.01)

(52) U.S. Cl. ..... 428/36.1; 428/107; 428/121; 428/131; 428/134; 428/213; 428/219; 428/220; 428/332; 428/901; 156/217; 156/218; 383/117; 383/908

(58) Field of Classification Search ..... None
See application file for complete search history.

(56) References Cited

U.S. PATENT DOCUMENTS

| | | | | | |
|---|---|---|---|---|---|
| 3,257,915 | A | * | 6/1966 | Cartier et al. | 493/196 |
| 4,059,713 | A | * | 11/1977 | Mercer | 428/36.1 |
| 4,140,826 | A | * | 2/1979 | Liu | 428/113 |
| 4,374,798 | A | * | 2/1983 | Mercer | 264/288.8 |
| 4,653,640 | A | * | 3/1987 | Akao | 206/455 |
| 4,756,946 | A | * | 7/1988 | Mercer | 428/136 |
| 4,911,872 | A | * | 3/1990 | Hureau et al. | 264/146 |
| 5,277,520 | A | * | 1/1994 | Travis | 405/129.6 |

(Continued)

FOREIGN PATENT DOCUMENTS

FR 1566717 * 3/1968

(Continued)

OTHER PUBLICATIONS

Machine Translation of FR1566717, Mar. 1968.*

*Primary Examiner*—David R Sample
*Assistant Examiner*—Jeff A Vonch
(74) *Attorney, Agent, or Firm*—Modiano & Associati; Albert Josif; Daniel J. O'Byrne

(57) ABSTRACT

A package particularly for horticultural products and food products in general, which can be manufactured with automatic packaging machines, comprising a sheet-like element in reel form, which is constituted by a biaxially-stretched polyethylene net which has a first plurality of filaments arranged substantially parallel to the longitudinal unreeling direction of the reel and a second plurality of filaments which are substantially perpendicular to the first plurality of filaments, the sheet-like element being folded and welded to itself at least at portions of the edges of the manufactured package.

5 Claims, 2 Drawing Sheets

U.S. PATENT DOCUMENTS

| | | | | | |
|---|---|---|---|---|---|
| 5,823,683 | A | * | 10/1998 | Antonacci et al. | 383/107 |
| 5,912,197 | A | * | 6/1999 | Madderom | 442/305 |
| 6,146,745 | A | * | 11/2000 | Altonen et al. | 428/219 |
| 2005/0003151 | A1 | * | 1/2005 | Jacoby | 428/131 |

FOREIGN PATENT DOCUMENTS

| | | | |
|---|---|---|---|
| FR | 1 566 717 | A | 5/1969 |
| GB | 2 034 240 | A | 6/1980 |
| WO | WO 99/15418 | A | 4/1999 |

* cited by examiner

PACKAGE, PARTICULARLY FOR HORTICULTURAL PRODUCTS AND FOOD PRODUCTS IN GENERAL, MANUFACTURABLE WITH AUTOMATIC PACKAGING MACHINES

TECHNICAL FIELD

The present invention relates to a package particularly for horticultural products and food products in general, which can be manufactured with automatic packaging machines.

BACKGROUND ART

As is known, horticultural products and food products, such as for example potatoes, citrus fruits and the like, are currently packaged by using packages which are substantially bag-shaped and are obtained by means of a net made of plastic material which is simply extruded, thereby suffering the drawback of having limited mechanical properties.

Another problem further consists in that the net has limited dimensional stability in the direction of its thickness, i.e., at right angles to the plane of extension of the net, therefore creating inevitably regions of limited contact with the contained product which might cause damage.

The use of biaxially-stretched polypropylene nets has not proved to be feasible, since such nets are unsuitable due to a defect of poor weldability, and therefore considerable difficulties would be encountered in forming the package and applying any advertising bands which might also have a structural purpose.

Another problem encountered with the background art further consists in that the amount of material that must be provided is relatively large, with consequent high costs, also as regards disposal thereof.

DISCLOSURE OF THE INVENTION

The aim of the present invention is to solve the problem described above by providing a package particularly for horticultural products and food products in general which can be manufactured with automatic packaging machines and allows to increase mechanical strength significantly while reducing the amount of material used.

Within this aim, an object of the invention is to provide a package which has a large coverage surface, understood as the part of the surface that is affected by the filaments and nodes of the net, with respect to the total surface of such net, so as to be able to create a particular aesthetic effect which allows to make the product more pleasant as a whole.

Another object of the present invention is to provide a package which has a smoother surface, reducing considerably any abrasion damage to the products contained in the package, at the same time also improving the impression of smoothness to the touch.

Still another object of the present invention is to provide a package, particularly for horticultural products and food products in general, which can be manufactured with automatic packaging machines and can be obtained easily starting from commonly commercially available elements and materials and is further competitive from a merely economical standpoint.

This aim and these and other objects of the present invention, which will become better apparent hereinafter, are achieved by a package particularly for horticultural products and food products in general, which can be manufactured with automatic packaging machines, characterized in that it comprises a sheet-like element in reel form, constituted by a biaxially-stretched polyethylene net which has a first plurality of filaments arranged substantially parallel to the longitudinal unreeling direction of the reel and a second plurality of filaments which are substantially perpendicular to said first plurality of filaments, said sheet-like element being folded and welded to itself at least at portions of the edges of the manufactured package.

BRIEF DESCRIPTION OF THE DRAWINGS

Further characteristics and advantages of the present invention will become better apparent from the description of a preferred but not exclusive embodiment of a package particularly for horticultural products and food products in general, which can be manufactured with automatic packaging machines, illustrated by way of non-limiting example in the accompanying drawings, wherein.

WAYS OF CARRYING OUT THE INVENTION

Figure 1:
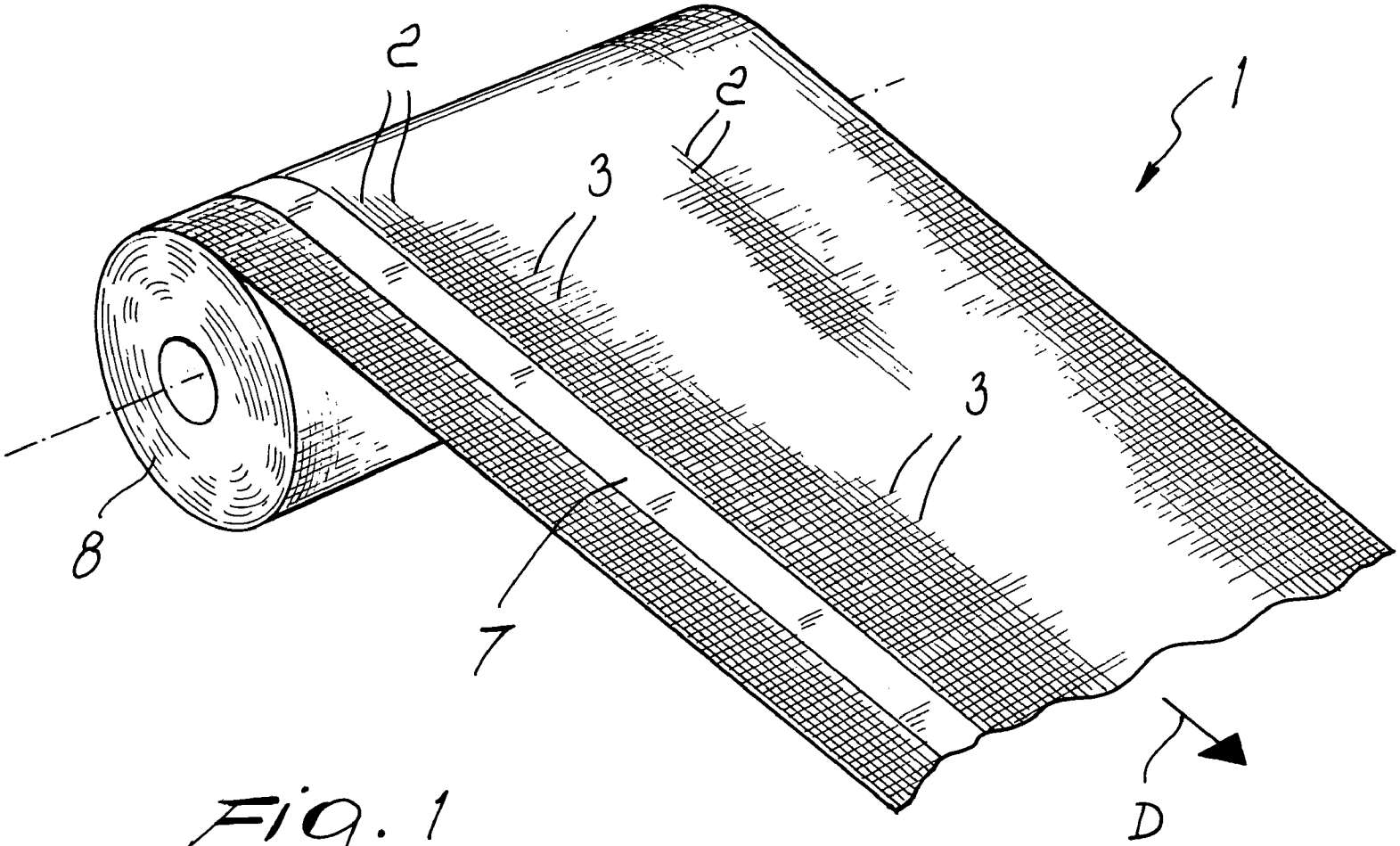
FIG. 1 is a perspective view showing a reel sheet element according to the invention.
Figure 2:
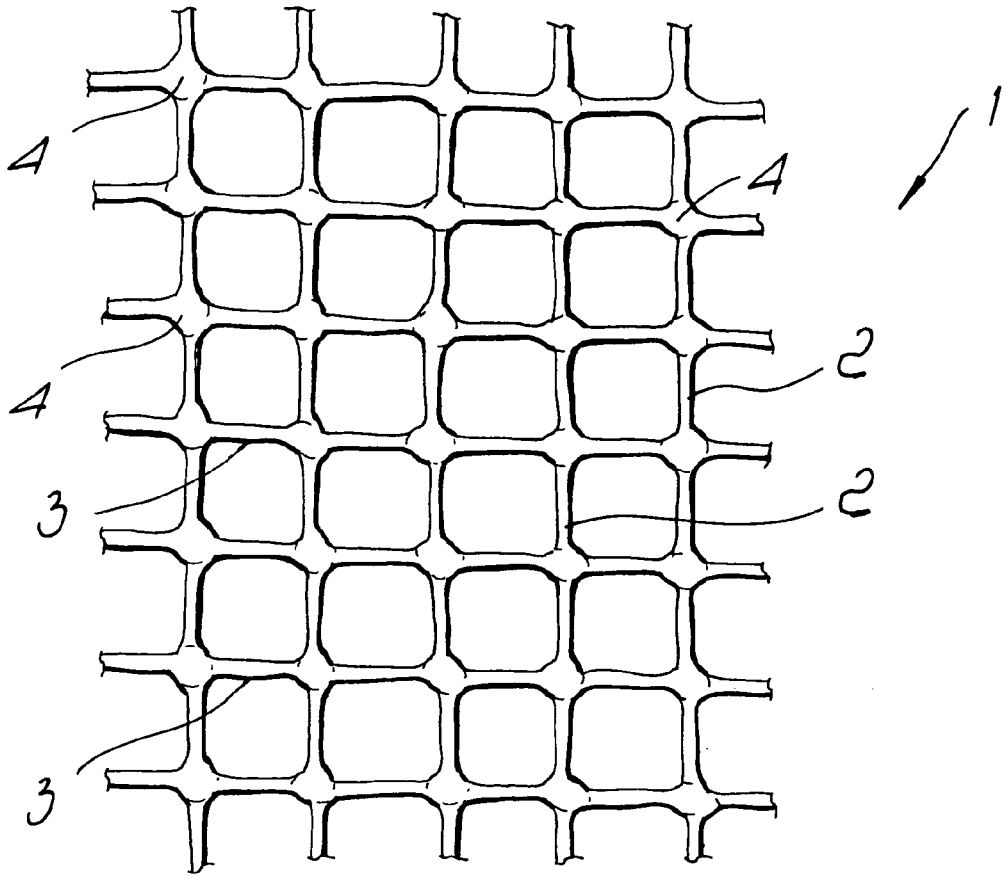
FIG. 2 is a schematic view of the biaxially-stretched net used to provide the package.
Figure 3:
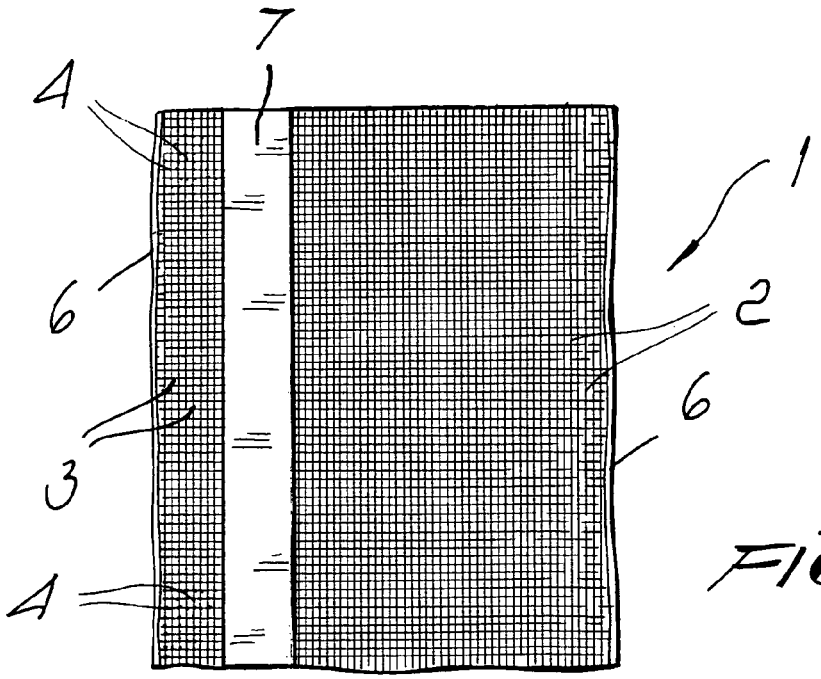
FIG. 3 is a schematic view of a package which can be manufactured according to the invention.

With reference to the figures, the package particularly for horticultural products and food products in general which can be manufactured with automatic packaging machines, according to the invention, comprises a sheet-like element in reel form, i.e. wound in a reel 8, which is constituted advantageously by a biaxially-stretched polyethylene net 1, which is constituted by a first plurality of filaments 2 which lie in the main direction, which is substantially parallel to the longitudinal unreeling direction D of the reel 8; the first plurality of filaments 2 intersects a second plurality of filaments 3, which are substantially perpendicular to the first plurality of filaments and consequently are arranged transversely.

A particular feature of the invention consists in that the process for stretching in the two directions is performed so as to maintain limited variability in the thickness of the net, i.e., obtaining a thickness among the various points affected by the filaments and by the nodes which is comprised within clearly defined margins, which will become better apparent hereinafter.

Substantially, a node 4 is provided which is thicker than the filament at right angles to the plane of extension of the net; the node is thicker than the filament by less than 50% and preferably by 15 to 40%.

Experimental tests that have been conducted have shown that it is advantageous to provide a filament thickness of approximately 0.17 mm and a maximum thickness at the node of less than 0.25 mm.

In order to increase the flatness of the net, such net, after the stretching operations, is advantageously subjected to flattening, so as to have a thickness which, by having limited variations between the region of the filaments and of the nodes, can be considered substantially constant.

The method used allows to increase considerably the coverage surface, obtaining a coverage surface ranging from 20 to 35% of the total surface.

It should be noted that by increasing the coverage surface, the contact surface is increased and the possibility of welding the net is improved in the regions of the edges designated by the reference numeral 6; it is further possible to weld bands or additional elements, designated by the reference numeral 7 and having advertising and/or structural purposes, to the outer surface of the resulting package.

The smoother surface of the net, thanks to the particular manufacturing process used, allows to reduce considerably damage to the product in the package and improves the impression of smoothness to the touch, in addition to allowing an overall weight reduction, which allows to have a weight per square meter ranging from 10 to 30 g per $m^2$.

For an equal covered surface and mechanical strength, the net according to the invention weighs approximately 50% less than traditional non-stretched nets.

It should also be noted that the tensile mechanical strength (or resistance to tensile stress) in the main direction can be estimated, per linear meter, at 0.90 to 1.30 kN/m, while the tensile strength at right angles to the above direction ranges from 1 to 1.50 kN/m.

Since a biaxially-stretched net has been used, for an equal tensile mechanical strength the product undergoes less deformation and advantageously a percentage deformation occurs, both longitudinally and transversely, which ranges from 28 to 38% of the initial dimension.

In order to optimize the embodiments, the number of filaments per linear meter ranges from 150 to 250 filaments/meter in both directions.

The terms "approximately" or "substantially" as herein used, mean that the features to which they refer are those indicated, but for the normal tolerances known to those skilled in the specific art.

From what has been described above it is therefore evident that the invention achieves the proposed aim and objects, and in particular the excellent mechanical strength of the net, combined with the structure with perpendicular filaments, allows increased traction during winding onto the reel for transport and also allows to increase the production rate and a better management of the idle times of the packaging machine, since it is possible to use longer reels 8.

The invention thus conceived is susceptible of numerous modifications and variations, all of which are within the scope of the appended claims.

All the details may further be replaced with other technically equivalent elements.

In practice, the materials used, as well as the contingent shapes and dimensions, may be any according to requirements.

The disclosures in Italian Patent Application No. MI2005A000964 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

What is claimed is:

1. A package, particularly for horticultural products and food products in general, which can be manufactured with automatic packaging machines, the package being made from a sheet-like element in reel form, which is constituted by a biaxially-stretched polyethylene net which has a first plurality of filaments arranged substantially parallel to the longitudinal unreeling direction of the reel and a second plurality of filaments which are substantially perpendicular to said first plurality of filaments, and after a biaxial stretching of said polyethylene net said first and second plurality of filaments intersect one another in nodes which have a thickness of less than 0.25 mm and which are thicker than said first and second plurality of filaments by an amount ranging from 15 to 40%, and said biaxially-stretched net subsequently being subjected to a flattening step so that the net has uniform thickness at said nodes and at said first and second plurality of filaments, and a coverage surface of said first and second plurality of filaments and of said nodes ranges from 20 to 35% of a total surface of said polyethylene net, said sheet-like element being folded and welded to itself at least at portions of edges of the sheet-like element to form the manufactured package.

2. The package according to claim 1, wherein after biaxial stretching and before flattening said filaments have a thickness of substantially 0.17 mm.

3. The package according to claim 1, wherein said net has a weight per square meter ranging from 10 to 30 g.

4. The package according to claim 1, wherein said first plurality of filaments has a tensile mechanical strength per linear meter ranging from 0.80 to 1.30 kN/m, said second plurality of filaments having a tensile mechanical strength per linear meter ranging from 1 to 1.5 kN/m.

5. The Package according to claim 1, wherein said first plurality of filaments and said second plurality of filaments have a density ranging from 150 to 250 filaments/meter.

* * * * *